US007270325B2

(12) United States Patent
Sano et al.

(10) Patent No.: US 7,270,325 B2
(45) Date of Patent: Sep. 18, 2007

(54) SHEET FEEDING APPARATUS, IMAGE READING APPARATUS, AND METHOD OF DETECTING DOUBLE FEED

(75) Inventors: Kazuhide Sano, Minamikoma-gun (JP); Syunichi Hirose, Minami-Alps (JP); Masashi Yamashita, Kofu (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 28 days.

(21) Appl. No.: 10/992,820

(22) Filed: Nov. 22, 2004

(65) Prior Publication Data

US 2005/0184453 A1 Aug. 25, 2005

(30) Foreign Application Priority Data

Dec. 4, 2003 (JP) ..... 2003-405441

(51) Int. Cl.
*B65H 7/02* (2006.01)

(52) U.S. Cl. ..... 271/262; 271/263; 271/265.04

(58) Field of Classification Search ..... 271/3.15, 271/3.17, 10.02, 10.03, 110, 626, 263, 258.01–258.04, 271/154, 155, 265.01, 265.04, 152, 262
See application file for complete search history.

(56) References Cited

U.S. PATENT DOCUMENTS 2,998,823 A * 9/1961 McCown et al. ..... 134/46
4,066,969 A * 1/1978 Pearce et al. ..... 367/125
4,237,378 A * 12/1980 Jones ..... 250/223 R
4,944,505 A * 7/1990 Sherman, III ..... 271/265.03
5,351,112 A * 9/1994 Naito et al. ..... 399/370
5,389,848 A * 2/1995 Trzaskos ..... 310/322
5,466,079 A * 11/1995 Quintana ..... 400/579
5,623,307 A * 4/1997 Kotidis et al. ..... 356/493
5,889,209 A * 3/1999 Piedrahita et al. ..... 73/570
6,027,108 A * 2/2000 Johdai et al. ..... 271/3.02
6,040,923 A * 3/2000 Takashimizu et al. ..... 358/498
6,053,495 A * 4/2000 Hara et al. ..... 271/263
6,161,831 A * 12/2000 Kusakabe et al. ..... 271/186
6,212,130 B1 * 4/2001 Brazeal et al. ..... 367/93
6,224,051 B1 * 5/2001 Nakayama et al. ..... 271/115
6,281,679 B1 * 8/2001 King et al. ..... 324/229
6,314,054 B1 * 11/2001 Priebsch ..... 367/93
6,324,900 B1 * 12/2001 Bruno et al. ..... 73/61.48
6,493,289 B2 * 12/2002 Kitaori et al. ..... 367/189
6,511,064 B1 * 1/2003 Phinney et al. ..... 271/262
6,520,498 B2 * 2/2003 Phinney ..... 271/263

(Continued)

FOREIGN PATENT DOCUMENTS

JP 6-49567 12/1994

(Continued)

*Primary Examiner*—Patrick Mackey
*Assistant Examiner*—Jeremy R. Severson
(74) *Attorney, Agent, or Firm*—Manabu Kanesaka

(57) ABSTRACT

A sheet feeding apparatus includes first and second transport devices disposed at a transport guide with a distance in between for nipping and transporting a sheet, and a double feed detection device disposed between the first transport device and the second transport device for detecting a double feed of the sheet. A sheet end detection device is disposed at a downstream side of the first transport device for detecting a trailing end of the sheet, and a determination device is provided for determining the double feed based on a detection signal from the double feed detection device and a detection signal from the sheet end detection device.

14 Claims, 12 Drawing Sheets

U.S. PATENT DOCUMENTS

| | | | | |
|---|---|---|---|---|
| 6,565,079 | B1 * | 5/2003 | Kakegawa et al. | 271/125 |
| 6,592,825 | B2 * | 7/2003 | Pelc et al. | 422/100 |
| 6,619,655 | B2 * | 9/2003 | Muller et al. | 271/152 |
| 6,691,578 | B1 * | 2/2004 | Puskas | 73/648 |
| 6,698,753 | B2 * | 3/2004 | Chujo et al. | 271/262 |
| 6,739,591 | B2 * | 5/2004 | Chujo et al. | 271/262 |
| 6,804,473 | B2 * | 10/2004 | Nakamura et al. | 399/16 |
| 6,874,778 | B2 * | 4/2005 | Nakano et al. | 271/111 |
| 6,898,151 | B1 * | 5/2005 | Lyon | 367/99 |
| 6,904,405 | B2 * | 6/2005 | Suominen | 704/235 |
| 6,917,326 | B1 * | 7/2005 | Tregenza et al. | 342/124 |
| 6,923,066 | B2 * | 8/2005 | Ogawa | 73/626 |
| 2001/0014477 | A1 * | 8/2001 | Pelc et al. | 436/49 |
| 2001/0042956 | A1 * | 11/2001 | Minoru et al. | 271/265.04 |
| 2002/0007118 | A1 * | 1/2002 | Adachi et al. | 600/443 |
| 2002/0020957 | A1 * | 2/2002 | Araki et al. | 271/10.11 |
| 2002/0060393 | A1 * | 5/2002 | Muller et al. | 271/110 |
| 2002/0066994 | A1 * | 6/2002 | Nakano et al. | 271/121 |
| 2002/0079644 | A1 * | 6/2002 | Phinney | 271/258.01 |
| 2003/0006550 | A1 * | 1/2003 | Chujo et al. | 271/262 |
| 2003/0060707 | A1 * | 3/2003 | Ogawa | 600/437 |
| 2003/0094748 | A1 * | 5/2003 | Chujo et al. | 271/262 |
| 2003/0208133 | A1 * | 11/2003 | Mault | 600/532 |
| 2004/0100018 | A1 * | 5/2004 | Phinney et al. | 271/262 |
| 2005/0034520 | A1 * | 2/2005 | Eisen et al. | 73/627 |

FOREIGN PATENT DOCUMENTS

| | | |
|---|---|---|
| JP | 10-257595 | 9/1998 |

* cited by examiner

SHEET FEEDING APPARATUS, IMAGE READING APPARATUS, AND METHOD OF DETECTING DOUBLE FEED

BACKGROUND OF THE INVENTION AND RELATED ART STATEMENT

The present invention relates to a sheet feeding apparatus for separating a sheet one by one from a stack of sheets placed on a stacker and feeding the sheet to a processing platen for processing the sheet such as reading or printing an image, and relates to an image reading apparatus with the sheet feeding apparatus. The present invention also relates to a method of detecting a double feed of a plurality of sheets during a sheet feeding process.

A sheet feeding apparatus is generally known as an apparatus for sequentially feeding a sheet one by one from a stack of sheets placed on a stacker to a processing platen in a printer, a copying machine, a scanner, or the like. When the sheet feeding apparatus attempts to separate one sheet at a time from a stack of sheets on a stacker and feed the sheet to a processing platen, two or more sheets may overlap with each other during the feeding process. In such a case, the sheets are fed to the processing platen without being properly separated from each other, which is called a double feed. When the double feed occurs, a wrong processing may be performed at the processing platen. Accordingly, if the sheets are not separated accurately, it is necessary to detect the double feed before the sheets reach the processing platen to stop the processing or cancel processed data such as reading.

A conventional method of detecting the double feed of sheets includes an ultrasonic sensor, a photo-sensor, or the like for detecting attenuation in an ultrasonic wave or an intensity of light passing through the sheet, thereby determining whether there is a single sheet.

Japanese Patent Publication (Kokai) No. 10-257595 discloses an ultrasonic sensor for detecting a sheet during transportation. A conventional ultrasonic sensor includes a piezoelectric oscillation plate such as piezoelectric ceramic at a wave transmission side and a similar oscillation plate at a wave reception side. A pulse voltage with a predetermined cycle is applied to the piezoelectric oscillation plate at the wave transmission side to generate oscillation, thereby transmitting an ultrasonic wave. The piezoelectric oscillation plate at the wave reception side receives the ultrasonic wave and converts to an electrical signal. Electric energy applied to the piezoelectric oscillation plate (wave transmission element) at the wave transmission side is compared with electric energy generated at the piezoelectric oscillation plate (wave reception element) at the wave reception side, thereby determining whether there is a single sheet.

When the double feed is detected with such an ultrasonic sensor, it is necessary to accurately measure the ultrasonic energy (electric energy output from the wave reception element) attenuated through the sheet between the wave transmission element and the wave reception element. U.S. Pat. No. 6,212,130 discloses a conventional structure in which a wave transmission element and a wave reception element are arranged opposite to each other with a predetermined angle relative to a surface of a sheet. With this structure, it is possible to prevent an ultrasonic wave transmitted from the wave transmission element from reflecting at the sheet surface and interfering.

Japanese Utility Model Publication (Kokai) No. 06-49567 proposes a structure in which a wave transmission element and a wave reception element are arranged opposite to each other between a downstream roller and an upstream roller arranged with a predetermined distance in between, thereby detecting the double feed while a sheet is in a stable condition. More specifically, with the structure, the double feed is detected while the downstream and upstream rollers nip the sheet in a straight position during transportation. Accordingly, it is possible to accurately detect the double feed since a leading end or a trailing end of the sheet is not curved or does not oscillate vertically.

When the double feed is detected with the conventional ultrasonic sensor or optical sensor, an instantaneous wave such as a burst wave is used to measure an amount of the wave transmitted through a sheet. With this method, when the sheets are overlapped and shifted in a feeding direction, it is difficult to accurately detect the double feed. Further, an image reading apparatus handles a wide variety of sheets in terms of quality, weight, and size. In such a case, it is necessary to provide a detection area with a predetermined length along a sheet transport direction, so that it is possible to apply a burst wave or a steady-state wave several times and detected signals are averaged for detecting the double feed.

As described above, Japanese Utility Model Publication (Kokai) No. 06-49567 discloses the structure in which the transport rollers are arranged separately with a predetermined distance in between in the feeding direction, so that the double feed is detected while the transport rollers nip a sheet. In Japanese Utility Model Publication (Kokai) No. 06-49567, a sheet sensor detects that the transport rollers at a downstream side nip a leading end of the sheet, and the double feed is detected based on a detection signal in this state. However, when the sheets are overlapped and shifted in the feeding direction, the double feed may be detected while a trailing end of the sheet leaves the transport rollers at a downstream side and is flapping, thereby causing a false detection.

In view of the problems mentioned above, an object of the present invention to provide a sheet feeding apparatus in which at least two transport devices are arranged at an upstream side and a downstream side in a feeding direction to obtain a specific measurement area in between while nipping and transporting a sheet. When the double feed is detected, the transport device at the upstream side securely nips a trailing end of the sheet.

Another object of the present invention is to provide a sheet feeding apparatus and a method of accurately detecting the double feed in which even when a sheet does not have a specific length, it is possible to accurately detect the double feed including a case that the sheets are overlapped and shifted in a feeding direction.

Further objects and advantages of the invention will be apparent from the following description of the invention.

SUMMARY OF THE INVENTION

To achieve the objects described above, according to the present invention, the following structure is provided for transporting a sheet from a stacker to a processing position to read an image and the like. At least two transport devices, i.e. first and second transport devices, are arranged on a sheet guide extending from the stacker to the processing position at positions with a distance in between for nipping and transporting a sheet. A double feed detection device such as an ultrasonic sensor and a sheet end detection device are arranged between the first and second transport devices for detecting a double feed and a trailing end of the sheet, respectively.

The first and second transport devices are arranged with an interval in between smaller than a length of a sheet with a smallest size to be transported, so that both of the first and second transport devices nip the sheet. An output signal from the double feed detection device is compared with a predetermined set value. In a case that the double feed detection device is formed of an ultrasonic sensor, a piezoelectric oscillation plate of a wave reception element generates an electric signal. A voltage or an integral value of a current and a voltage of the electric signal is compared with the predetermined set value. The set value is determined experimentally in advance as a voltage or an integral value of a current and a voltage generated in the wave reception element in a case of a single sheet and two or more overlapped sheets. Accordingly, when the wave reception element generates the electric signal greater than the predetermined set value, it is determined that there is only one sheet, and when the wave reception element generates the electric signal smaller than the predetermined set value, it is determined that there is two or more sheets.

A plurality of predetermined set values may be set for determining whether there is no sheet or one sheet, and whether there is one sheet or two sheets. Accordingly, it is possible to detect the presence and the number of the sheets.

In the present invention, the sheet end detection device is disposed at a downstream side of the first transport device (transport device disposed on an upstream side in the sheet transport direction) for detecting the trailing end of the sheet. A transport amount (length) of the sheet is determined according to a period of time from when the double feed detection device transmits a detection signal to when the trailing end of the sheet passes the sheet end detection device. When the transport amount of the sheet is smaller than a predetermined transport length, the detection signal of the double feed detection device is nullified and the sheet overlapping state is determined. The transport length of the sheet may be determined through a period of time that rollers or belts constituting the first and second transport devices rotate at a constant speed, or a rotational amount of one of the first and second transport devices.

A first comparison device compares the output signal from the double feed detection device with a reference value in voltage or electric power predetermined according to the sheet overlapping state. A second comparison device compares the transport amount of the sheet detected through a period of time from when the double feed detection device transmits a detection signal to when the trailing end of the sheet passes the sheet end detection device with a predetermined length. The first and second comparison devices are formed of a logic circuit or a CPU of a computer.

The predetermined length is set to be equal to or greater than a distance between the first transport device and the sheet end detection device. Accordingly, it is possible to determine that the output signal from the double feed detection device is output when the first transport device nips the trailing end of the sheet or when the trailing end of the sheet passes the first transport device and moves freely. It is possible to determine the double feed based on the output signal from the double feed detection device while the first and second transport devices nip the sheet.

According to the present invention, a method is for detecting a double feed when at least two transport devices, first and second transport devices, transport a sheet from a stacker to a predetermined position. The method includes a double feed detection step of detecting the double feed while the sheet is transported between the first and second transport devices; a distance measurement step of measuring a transport length of the sheet during a period of time from when a sheet overlap detection signal is output in the double feed detection step to when a trailing end of the sheet reaches a predetermined position; and a double feed determination step of determining that the double feed detected in the double feed detection step is valid when the transport length of the sheet is greater than a predetermined length.

DETAILED DESCRIPTION OF PREFERRED EMBODIMENTS

Figure 1:
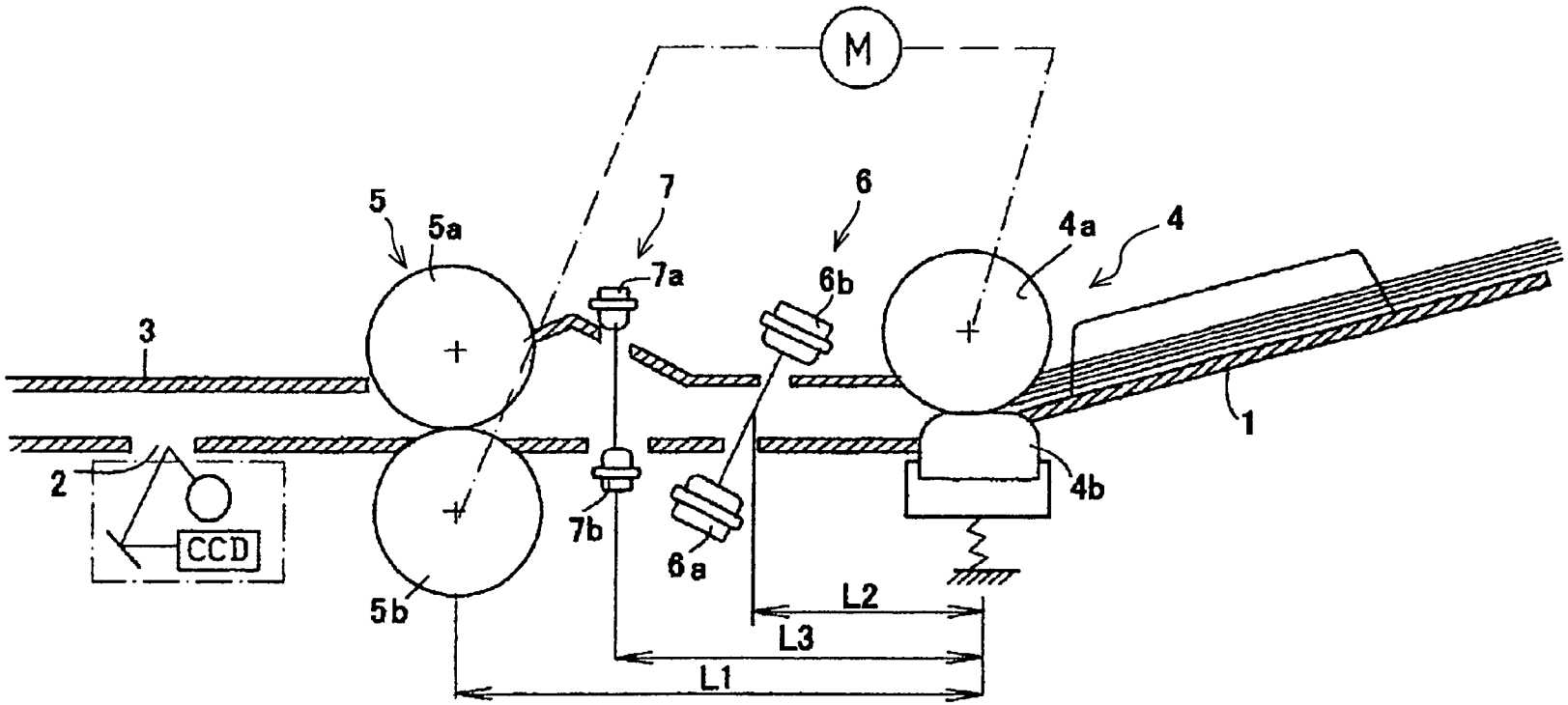
FIG. 1 is a schematic cross sectional view of a sheet feeding apparatus according to the present invention.
Figure 2:
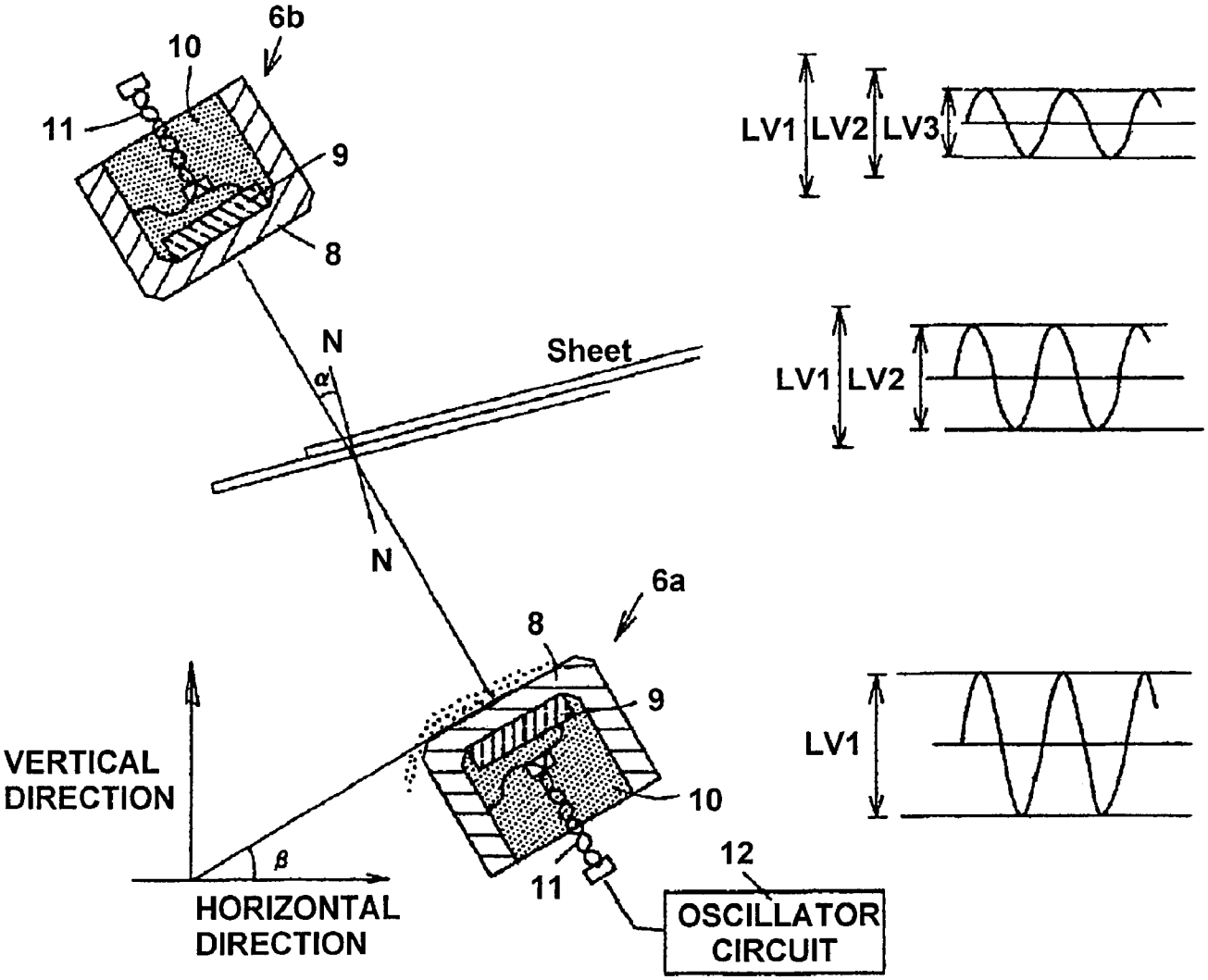
FIG. 2 is a schematic view of an ultrasonic sensor used as a double feed detection device in the sheet feeding apparatus shown in FIG. 1.
Figure 3:
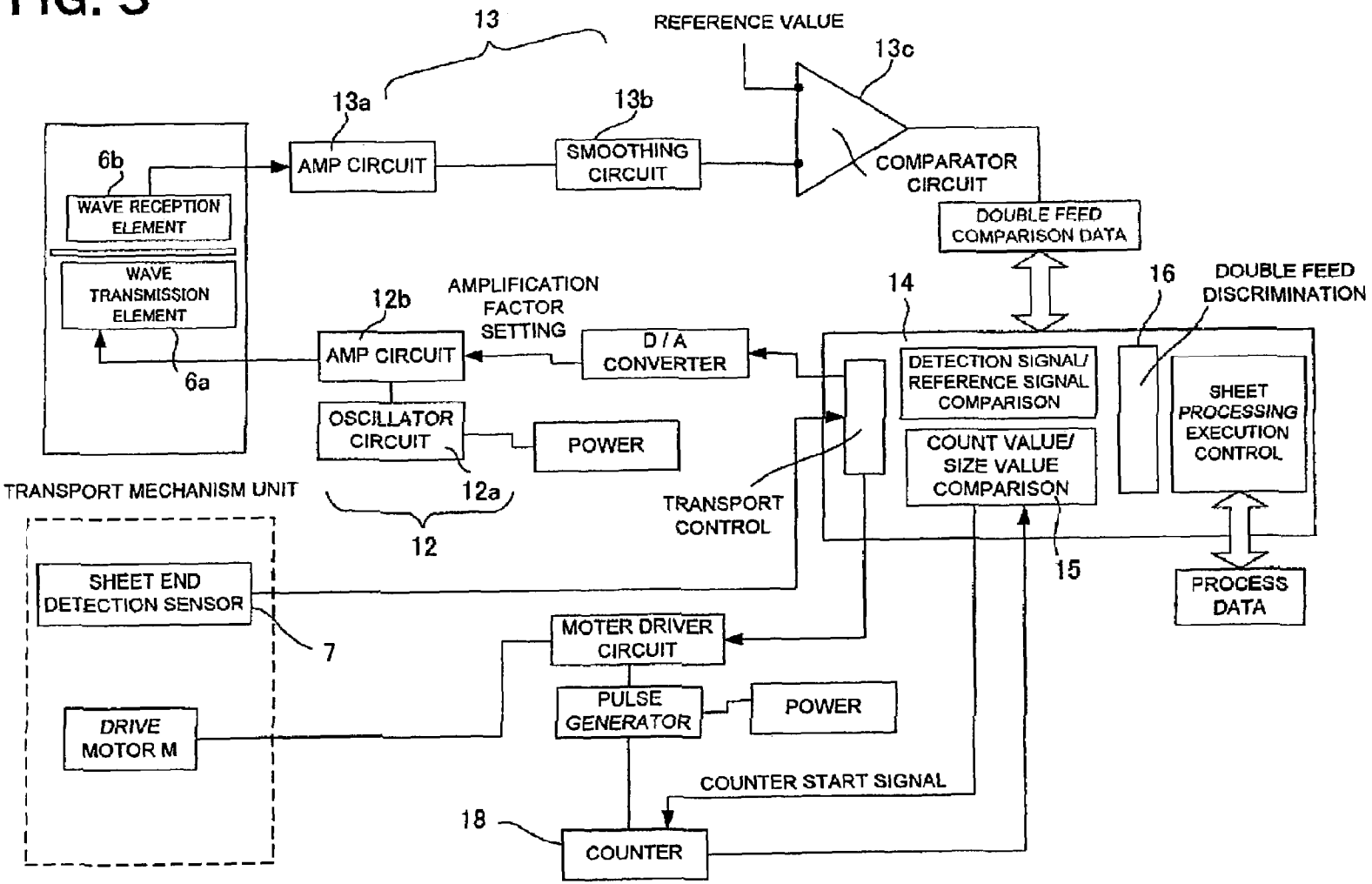
FIG. 3 is a block diagram showing a control circuit of the sheet feeding apparatus shown in FIG. 1.

Hereunder, embodiments of the present invention will be explained with reference to the accompanying drawings. FIG. 1 is a schematic view showing a mechanism of a sheet feeding apparatus according to the present invention. FIG. 2 is a schematic view showing a structure of an ultrasonic sensor as an example of a double feed detection device. FIG. 3 is a block diagram showing a control circuit of the sheet feeding apparatus shown in FIG. 1. The present invention is applied to a sheet feeding portion of an image reading apparatus (described later) such as a copying machine, a printing machine, and the like. The sheet feeding portion has the following structure for separating a sheet at a time from a stack of sheets loaded in a stacker and feeding the sheet to a processing position such as an image reading platen, a printing platen, and the like.

Referring to FIG. 1, a sheet guide 3 for guiding a sheet is disposed between a stacker 1 for loading a stack of sheets and a processing platen 2. At least two transport devices 4 and 5 are provided separately with a distance in between along the sheet guide 3. In general, a sheet transport path is formed of the sheet guide extending from the stacker to the processing platen. Transport rollers and transport belts are disposed along the sheet transport path. In the embodiment, the two transport devices are arranged with a distance in between, and a double feed detection device and a sheet end detection device are arranged between the transport devices.

In the sheet feeding apparatus shown in FIG. 1, the first transport device 4 and the second transport device 5 are disposed on the sheet guide 3 with a distance L1 in between. The first transport device 4 separates one sheet at a time from a stack of the sheets loaded in the stacker 1. The second transport device 5 sets the sheet transported from the first transport device 4 in a temporary standby state. The first transport device 4 includes a separation roller 4*a* turning in a clockwise direction in FIG. 1 and a friction pad 4*b* pressed against the separation roller 4*a*. The first transport device 4 separates and feeds one sheet at a time from a stack of the sheets loaded in the stacker 1. Various types of separation devices are known. A belt may be used instead of the separation roller 4*a*. A backward rotation (retard) roller or belt may be used instead of the friction pad 4*b*.

The second transport device 5 may be formed of a pair of rollers or belts pressed against each other. The second transport device 5 may be arranged so as to receive the sheet from the first transport device 4. As shown in FIG. 1, the second transport device 5 may be configured to set the sheet fed from the first transport device 4 in the temporary standby state and then transport the sheet toward the processing platen 2 upon a paper feed timing signal. Each of the first and second transport devices 4 and 5 may be connected to an individual drive motor. The first and second transport devices 4 and 5 can be connected to a drive motor M capable of turning in forward and backward directions. The first transport device 4 rotates when the drive motor M turns in the forward direction. The second transport device 5 rotates when the drive motor M turns in the reverse direction (described later with reference to FIGS. 8A and 8B).

The first and second transport devices 4 and 5 rotate reciprocally. The first transport device 4 is formed of the separation roller 4*a* for separating and feeding the sheet from a stack of the sheets in the stacker 1. After the sheet is forwarded to the second transport device 5, the separation roller 4*a* stops, thereby preventing a subsequent sheet from being fed from the stacker 1. Accordingly, the first and second transport devices 4 and 5 are synchronized with each other for transporting the sheet in the same direction.

The feed detection device 6 and the sheet end detection device 7 are arranged between the first and second transport devices 4 and 5. The double feed detection device 6 is formed of an ultrasonic sensor including a wave transmission element 6*a* and a wave reception element 6*b*. The wave transmission element 6*a* and the wave reception element 6*b* are disposed at opposite positions as a pair via the sheet traveling along the sheet guide 3. As shown in FIG. 1, the wave transmission element 6*a* and the wave reception element 6*b* are arranged in an inclined state with an angle $\alpha$ of 30° to 45° relative to a normal line N-N perpendicular to a sheet traveling surface (described later).

The sheet end detection device 7 is formed of an optical sensor such as a photodiode including a light emitting element and a light reception element disposed at opposite positions via the sheet traveling along the sheet guide 3. The double feed detection device 6 and the sheet end detection device 7 are disposed between the first transport device 4 and the second transport device 5 on a downstream side in the sheet transport path at a distance L2 and a distance L3 from the first transport device 4, respectively.

FIG. 2 shows an example of the double feed detection device 6. The wave transmission element 6*a* and the wave reception element 6*b* have a same construction. Specifically, a piezoelectric oscillation body 9 such as a piezoelectric ceramic board is embedded in an elastic resin 10 housed in an outer cabinet case 8 formed of metal or the like. Electrodes are formed on front and back sides of the piezoelectric oscillation body 9 through vapor deposition. An RF power is supplied thereto through a lead 11.

The piezoelectric oscillation body 9 shown in FIG. 2 tightly contacts the outer cabinet case 8 so that the two oscillate integrally. One end of the lead 11 is grounded to the outer cabinet case 8. Accordingly, when the RF power is supplied through the lead 11 to the wave transmission element 6*a*, the piezoelectric oscillation body 9 and the outer cabinet case 8 in tight contact oscillate at a predetermined frequency to generate an ultrasonic wave. The piezoelectric oscillation body 9 integrated with the outer cabinet case 8 on a side of the wave reception element 6*b* oscillates. Electric energy generated in the piezoelectric oscillation body 9 is output from the lead 11.

The ultrasonic sensor described above is disposed in the sheet guide 3 as the double feed detection device 6. The ultrasonic sensor is connected to an oscillator circuit 12 and a receiver circuit 13 shown in FIG. 3. The oscillator circuit 12 includes an oscillator circuit 12*a* and an amplifier circuit 12*b*. The receiver circuit 13 includes an amplifier circuit 13*a* formed of a transistor or the like and a smoothing circuit 13*b*. The oscillator circuit 12*a* generates an RF voltage with a frequency of, for example, 30 kHz to 400 kHz. The RF signal is amplified by a transistor and applied to the piezoelectric oscillation body 9 through the lead 11. The piezoelectric oscillation body 9 thereby generates an ultrasonic wave. The ultrasonic wave excites the piezoelectric oscillation body 9 on the wave reception element side through the sheet, and is output electrically. An input signal from the wave reception element 6*b* is amplified by a transistor and rectified by the smoothing circuit 13*b*. The input signal is then smoothed by an integrating circuit such as a capacitor.

Figure 4:
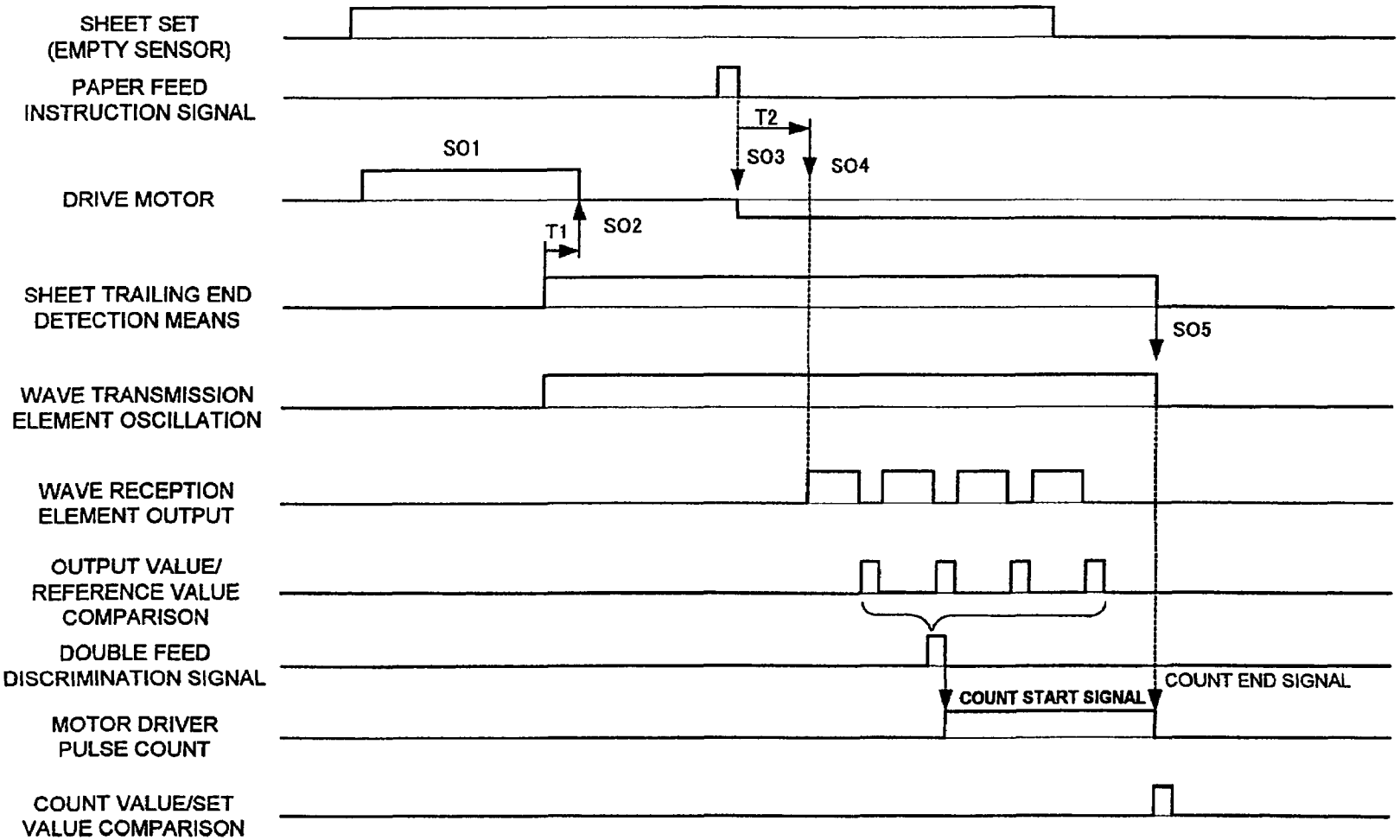
FIG. 4 is a timing chart for explaining control of the sheet feeding apparatus shown in FIG. 1.

FIG. 4 is a timing chart for explaining control of the sheet feeding apparatus shown in FIG. 1. An empty sensor detects a stack of the sheets loaded in the stacker 1. The drive motor M of the first and second transport devices 4 and 5 turns in a forward direction (S01). When the empty sensor of the stacker is activated, a control unit 14 is turned on (described later). The drive motor M rotates the separation roller 4*a* of the first transport device 4 in the clockwise direction, thereby feeding the sheet to the second transport device 5. A register roller pair 5*a* is kept in a stationary state. The separation roller 4*a* picks up and feeds the sheet from the stack on the stacker 1. The sheet passes the double feed detection device 6 and the sheet end detection device 7 to reach the register roller pair 5*a*.

When the sheet end detection device 7 detects the leading end of the sheet, a timer T1 starts (S02). The timer T1 measures a period of time during rotations of the separation roller 4*a* so that the leading end of the sheet reaches the register roller pair 5*a* and is curved, thereby forming a loop in the sheet. When the loop is formed, a stop signal is transmitted to stop the drive motor M. When a paper feed instructions signal is transmitted from a processing unit of the apparatus such as an image reading apparatus (S03), the drive motor M turns backward. At the same time, a timer T2 starts. The drive motor M rotates the register roller pair 5*a* in the clockwise direction, thereby feeding the sheet toward the processing platen 2. At this time, the separation roller 4*a* becomes a stationary state. The timer T2 measures a period of time during a removal of the loop at the leading end of the sheet, and the sheet is supported in a straight form between the separation roller 4*a* and the register roller pair 5*a*. When the timer T2 expires, a double feed detection start signal is transmitted (S04).

When the sheet end detection device 7 detects the trailing end of the sheet as the sheet travels forward, a double feed detection end signal is transmitted (S05). The following processing is executed during a period of time from the double feed detection start signal (S04) to the double feed detection end signal. The double feed detection start signal is transmitted after a predetermined period of time (timer T2) after the leading end of the sheet is detected by the sheet end detection device 7. The double feed detection end signal is transmitted when the trailing end of the sheet is detected.

The processing is executed specifically as follows. The wave transmission element 6*a* of the ultrasonic sensor forming the double feed detection device 6 supplies an electric power to the oscillator circuit 12*a*, so that the ultrasonic wave is generated continuously or intermittently. Then, an output corresponding to a condition of the sheet traveling along the sheet transport path is applied to the wave reception element 6*b* via the amplifier circuit 13*a* and the smoothing circuit 13*b*. A value of the output is compared with a predetermined reference value by a comparator circuit 13*c*. That is, electric energy of an oscillation wave output from the wave reception element 6*b* is amplified and rectified. The electric energy is then compared with a reference value by a comparator or other comparison device after processed into an output level as shown in FIGS. 6A and 6B by the smoothing circuit 13*b* formed of an integrating circuit.

Figure 6A:
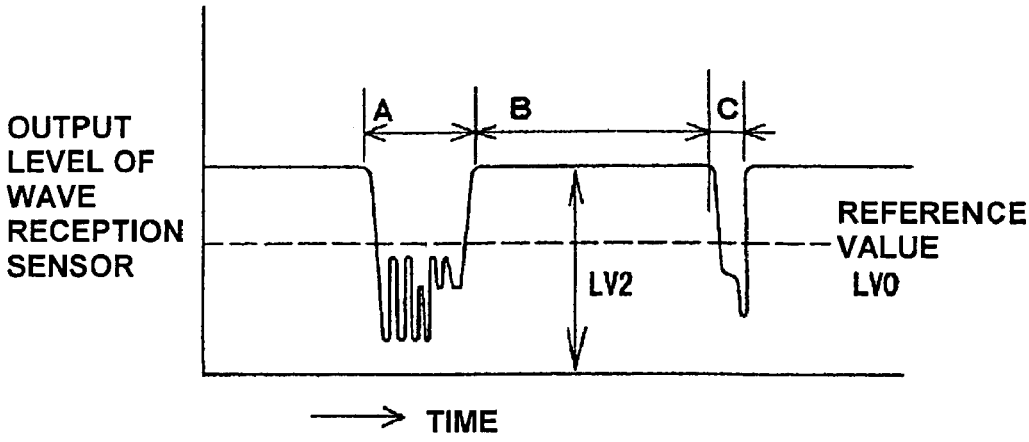
FIGS. 6A and 6B are graphs showing waveforms of an output signal from the ultrasonic sensor shown in FIG. 2.

FIG. 6A shows a typical output level when there is a single sheet is transported. A portion A shows that the detected values are disturbed before the leading end of the sheet reaches the register roller pair 5*a*. A portion B shows that the detected values are stabilized, in which the sheet is nipped by the separation roller 4*a* and the register roller pair 5*a*. A portion C shows that the detected values are disturbed after the trailing end of the sheet passes (moves away) the separation roller 4*a*. FIG. 6B shows an output level when there are two sheets overlapping each other. The portions. A, B, and C represent the same conditions as noted above.

Figure 6B:
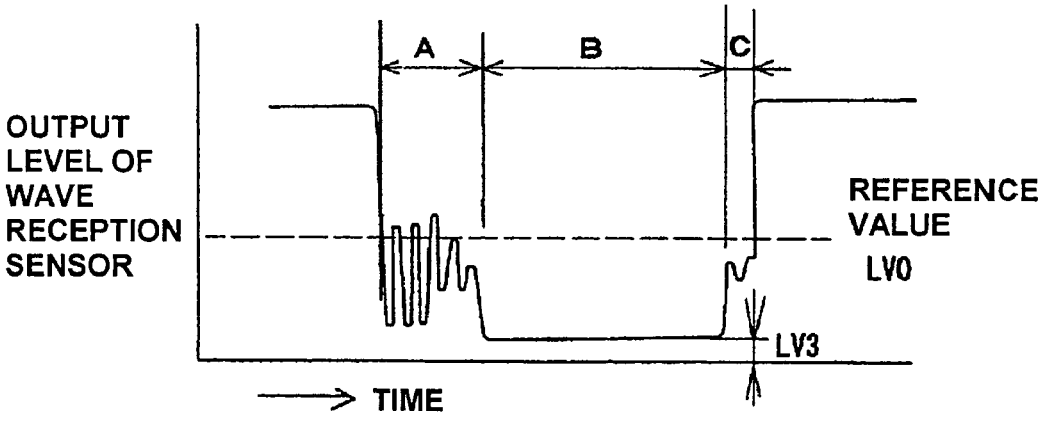

When the reference value is set at a level shown by a hidden line in FIGS. 6A and 6B, an output from the comparator determines whether there is one sheet shown in FIG. 6A or two sheets shown in FIG. 6B for the stabilized portion B. When the ultrasonic wave is continuously transmitted from the oscillator circuit 12*a*, the output data from the smoothing circuit 13*b* is divided using a reference clock of the CPU or the like. Each divided data is then sequentially compared with the reference value by the comparator circuit 13*c*. The results are stored in a buffer memory, and the sheet overlap condition is sequentially evaluated for each division.

A double feed determination signal (double feed determination data) is next output and transferred to the control unit 14 (FIG. 4) of the CPU or the like (S04). A transport amount of the sheet by the first and second transport devices 4 and 5 is then detected.

As shown in FIG. 1, the stepping motor is used as the drive motor M. A counter is used for counting the number of pulses of a drive power source for the drive motor M. The transport amount of the sheet is obtained from the pulse count value. Alternatively, the transport amount of the sheet may be estimated as follows. Specifically, the transport devices are driven at a predetermined speed and an elapsed time of a timer is determined based on a comparison data signal. For example, the count value may be estimated from the reference clock of the control CPU. An encoder may be installed on a rotary shaft of a transport roller rotating in synchronism with the sheet. The transport amount of the sheet is identified from the amount of revolution. That is, it is appropriate to detect the transport amount of the sheet using a distance measurement device such as the encoder that actually determines the transport amount of the sheet. Or, it is appropriate to use a timekeeping device by counting the reference clock.

In either case, the operations follow the pattern as follows. Specifically, counting by the counter is started upon the output of the double feed determination signal. The trailing end of the sheet is checked with the sheet trailing end detection device when the sheet is transported for a predetermined distance or L3 plus $\alpha$. When the sheet trailing end detection device determines that there is a sheet present, the double feed is validated. When the device determines that there is no sheet present, the double feed detection signal is canceled.

Figure 5:
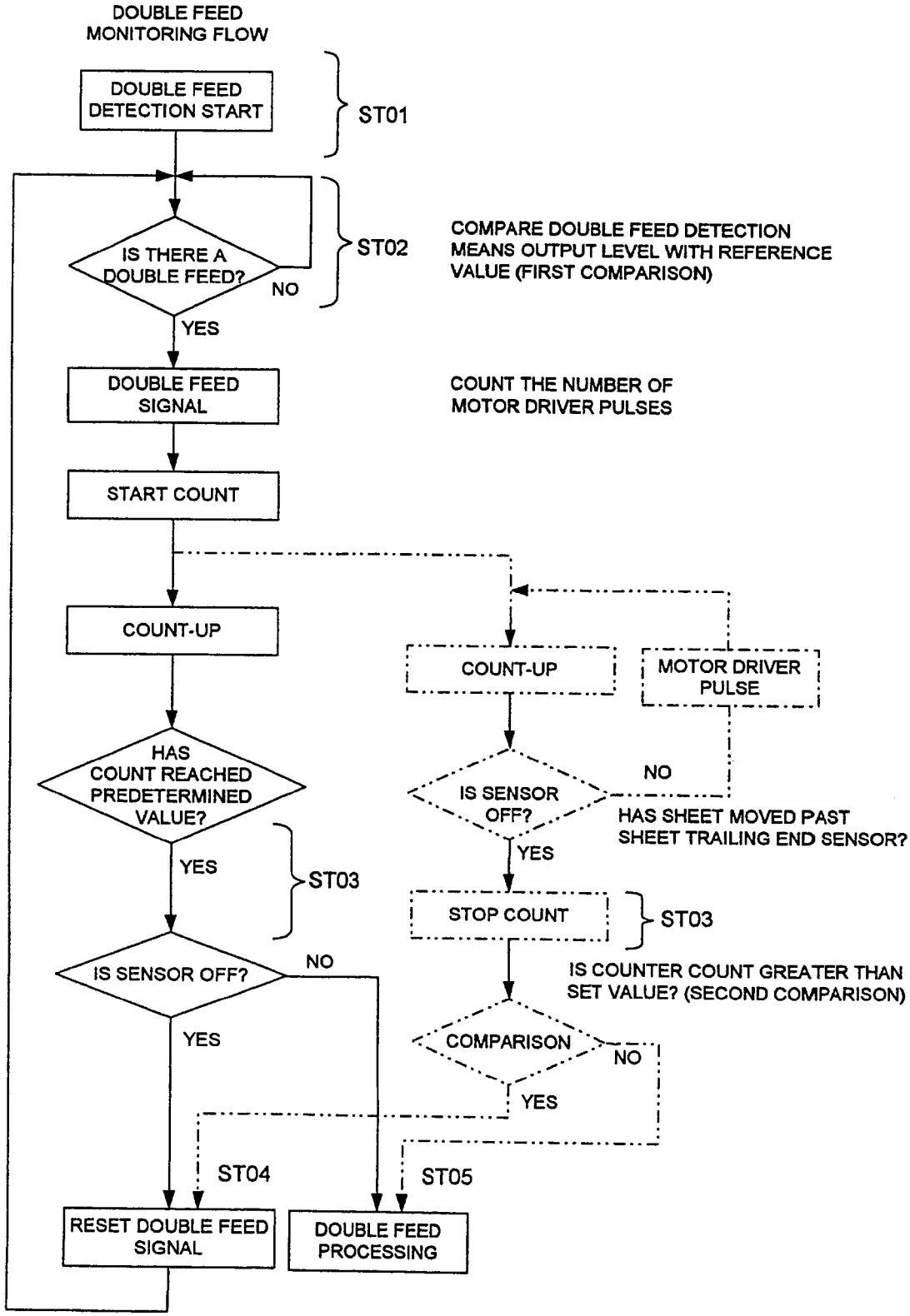
FIG. 5 is a flowchart for explaining control of the sheet feeding apparatus shown in FIG. 1.

Alternatively, referring to a portion indicated by a hidden line in FIG. 5, the transport amount (length) of the sheet is detected with the timing, at which the double feed determination signal is output, as a starting point. The measurement sequence is terminated upon the output of the double feed detection end signal from the sheet end detection device 7. A substantial length (distance), over which the sheet is transported, is thus detected. The sheet transport length is, for example, output as a counter count. The counter count is compared with a predetermined count value. The predetermined count value, or the sheet transport length, is set so as to be equal to the distance L3 between the first transport device 4 and the sheet end detection device 7. The count value may be set to be slightly greater (longer) than the distance L3 to make up for variations from one apparatus to another or ensure accuracy of detection. The length over which the sheet is actually transported (a measured length) is compared with the length set from the distance L3 (a set length) using a comparator or other comparison device.

Comparison data from the comparator circuit 13*c* and a transport length comparator circuit 15 are fed to the double feed determination device 16. The double feed determination device 16 thereby determines whether or not there is a double feed. The double feed determination device 16 shown in the figure is built into the CPU of the control unit 14. The determination device 16 transmits a double feed signal for the comparison data from the comparator circuit 13*c* indicating there are two or more sheets involved. If the comparison data from the comparator circuit 15 is greater than the reference value, the determination device 16 enables the double feed signal and sends the signal to a double feed processing step. If the comparison data is smaller than the reference value, the determination device 16 disables and abandons the double feed signal.

A sequence of operations will be described with reference to the flowchart shown in FIG. 5. A double feed detection sequence is started when the double feed detection start signal is received from the timer T2 (ST01). The output value from the wave reception element 6*b* is smoothed for a predetermined period of time, for example, 1 ms based on the reference clock of the CPU. The value is compared with the reference value by the comparator circuit 13*c*. If the output value is smaller than the reference value, it is determined that there is the double feed of two or more sheets overlapping each other. The results are then stored in the memory. If the output value is greater than the reference value, the next output value is subjected to determination (ST02).

When the comparator circuit 13*c* determines that there is the double feed, the counter 18 is used to count the number of power pulses for the drive motor M. The count value data is transferred to the comparator circuit 15 upon the output of the sheet trailing end detection signal from the sheet end detection device 7 (ST03). If the comparator circuit 15 determines that the count value data is smaller than the set value, the double feed signal stored in a shift register is disabled and cleared. A processing of the subsequent output data will be executed in the same manner (ST04). If the count value data is found to be grater than the set value, the double feed signal is enabled and an alarm display is executed (ST05).

Figure 7:
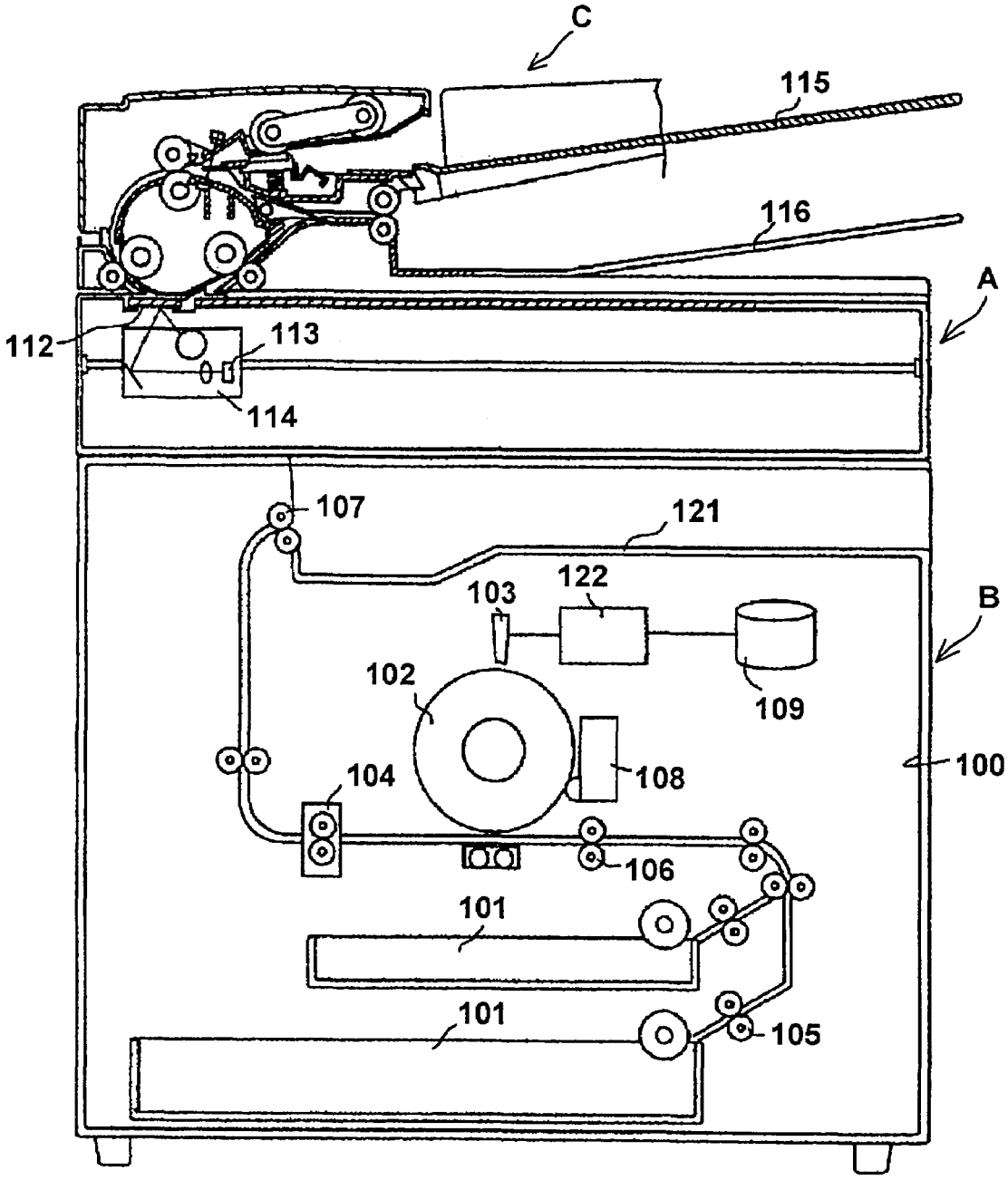
FIG. 7 is a cross sectional view showing an image forming apparatus with an image reading apparatus as a unit according to the present invention.
Figure 8A:
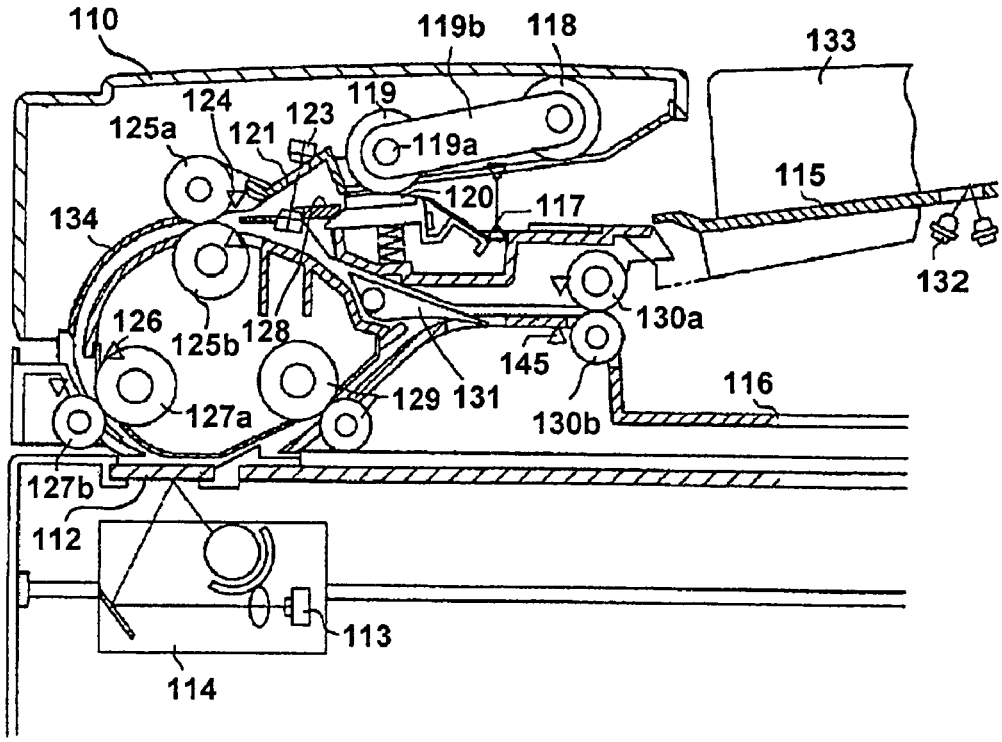
FIG. 8A is a cross sectional view showing a detailed structure of a document sheet feeding portion of the image forming apparatus shown in FIG. 7.

An image reading apparatus according to an embodiment of the present invention will be described. FIG. 7 is a view illustrating an image reading apparatus A mounted on a sheet feeding apparatus C and an image forming apparatus B including the image reading apparatus A. FIG. 8A is a view illustrating details of a sheet feeding portion of the sheet feeding apparatus C. The image forming apparatus B including the image reading apparatus A (described later) contains a print drum 102, a paper feeding cassette 101, a developing unit 108, and a fusing unit, all housed in a casing 100.

The paper feeding cassette 101 supplies the print drum 102 with paper. The developing unit 108 forms a developed image on the print drum 102 with toner ink. A reference numeral 103 represents a print head, such as a laser, for forming a latent image on the surface of the print drum 102. Paper fed from the paper feeding cassette 101 is transported to the print drum 102 by a transport roller 105. An image formed by the print head 103 is fixed permanently by a fixing unit 104. The paper, on which the image is formed, is fed into an exit paper stacker 121 by an exit roller 107.

The image forming apparatus B as described above is widely known as a printer. The printer includes a paper feeding portion, a print portion, and an exit paper storage portion as functional portions. The functional portions are not limited to those described in the foregoing. Various other types may be employed, including, for example, an ink jet printing, a silk screen printing, and the like.

The print head 103 is electrically connected to a storage device 122 and a data management control circuit 109. The storage device 122, such as a hard disk, stores image data. The data management control circuit 109 transfers the stored image data sequentially to the print head. The image reading apparatus A is mounted as a unit on the image forming apparatus B.

The image reading apparatus A is constructed as follows. Specifically, a platen 112 is mounted on the casing 100. An optical mechanism 114 and a photoelectric conversion element 113 are disposed via the platen for reading a document sheet. A CCD or the like is known as the photoelectric conversion element 113.

A sheet feeding apparatus C shown in FIG. 7 is installed to the platen 112. The sheet feeding apparatus C includes a paper feeding stacker 115 and a paper exit stacker 116 juxtaposed vertically above the platen 112. A sheet from the paper feeding stacker 115 is guided with a U-shaped transport path 134 to the paper exit stacker 116 via the platen 112. An empty sensor 117 and a size sensor 132 are disposed in the paper feeding stacker 115. The empty sensor 117 detects a sheet loaded in the paper feeding stacker 115. A reference numeral 133 in the figure represents an edge guide for regulating an edge of the sheet. The size sensor 132 and the edge guide 133 will be described later with reference to FIG. 8B.

A separation roller 119 and a friction pad 120 contacting tightly therewith are disposed at a downstream side of the paper feeding stacker 115. A kick roller 118 is mounted on a bracket 119*b* fitted to a rotary shaft 119*a* of the separation roller 119. If the rotary shaft 119*a* is rotated in the clockwise direction, the kick roller 118 lowers onto the paper feeding stacker 115. If the rotary shaft 119*a* is rotated in the counterclockwise direction, the kick roller 118 moves up into the position shown in FIG. 8A (described later).

A double feed detection device 123 and a sheet end detection device 124 are disposed in the transport path 134 at a downstream side of the separation roller 119. The double feed detection device 123 detects the sheet overlap condition. The sheet end detection device 124 detects the leading end and the trailing end of the sheet. Further, register rollers 125*a* and 125*b*, feed rollers 127*a* and 127*b*, an unloading roller 129, and exit rollers 130*a* and 130*b* are disposed, in this order, on the transport path 134. The sheet is transported from the paper feeding stacker 115 to the paper exit stacker 116.

A reference numeral 126 represents a lead sensor for detecting the leading end of the sheet. A reference numeral 128 represents a guide for providing a backup for the sheet at a position of the platen 112. A reference numeral 131 represents a path changing gate for circulating the sheet from the platen 112 to the register rollers 125*a* and 125*b*.

Figure 8B:
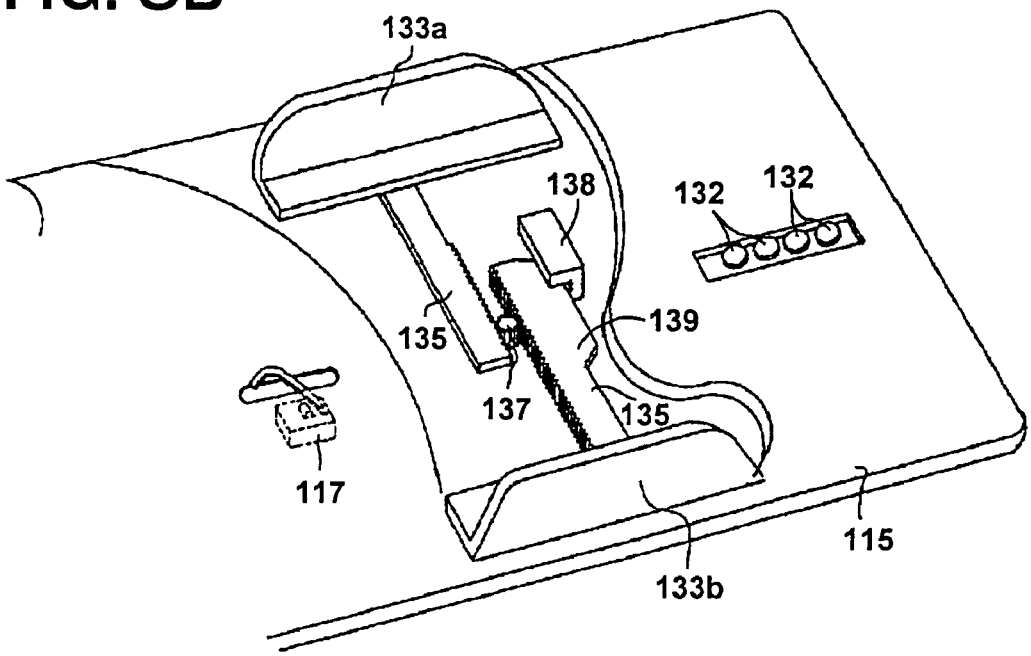
FIG. 8B is a perspective view for explaining a process of detecting a size of paper on a sheet feeding stacker of the image forming apparatus shown in FIG. 7.

The edge guide 133 and the size sensor 132 will be described with reference to FIG. 8B. The edge guide 133 mounted in the paper feeding stacker 115 includes a pair of right and left edge guides (133*a* and 133*b*) for regulating respective edges of the sheet. The right and left edge guides are mounted slidably in a width direction of the sheet. Racks 135 and 136 are integrally provided for the edge guides 133*a* and 133*b*, respectively. The racks 135 and 136 engage a pinion 137 rotatably secured to the paper feeding stacker 115.

Each of the right and left edge guides 133*a* and 133*b* is moved by the same amount in opposite directions by the pinion 137. A detection tab 139 formed of a protrusion is provided in the rack 136, i.e. one of the two racks. The detection tab 139 is located at a position corresponding to a width of the sheet. A position sensor 138 mounted on a bottom surface of the paper feeding stacker 115 detects a position of the detection tab 139. The position sensor 138 is formed of a slidac variable transformer. The position sensor 138 exhibits variable resistances according to an extent of engagement with the detection tab 139. An output of the position sensor 138 thus determines a position of the edge guide 133. The paper feeding stacker 115 also includes a plurality of size sensors 132 for detecting the trailing end of the sheet.

The position sensor 138 detects a width of the sheet on the paper feeding stacker 115. For the sheets having a same width, the size sensors 132 detects lengths of the sheets to determine sizes of the sheets on the paper feeding stacker 115.

Figure 9A:
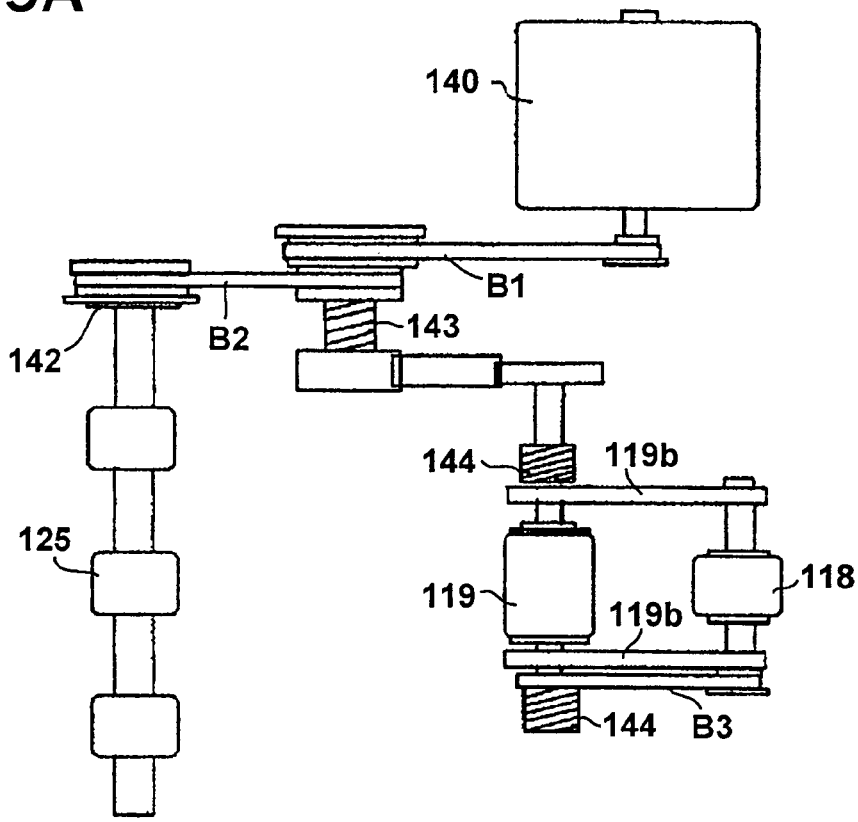
FIGS. 9A and 9B are views showing driving mechanisms of the document sheet feeding portion shown in FIG. 8A.
Figure 9B:
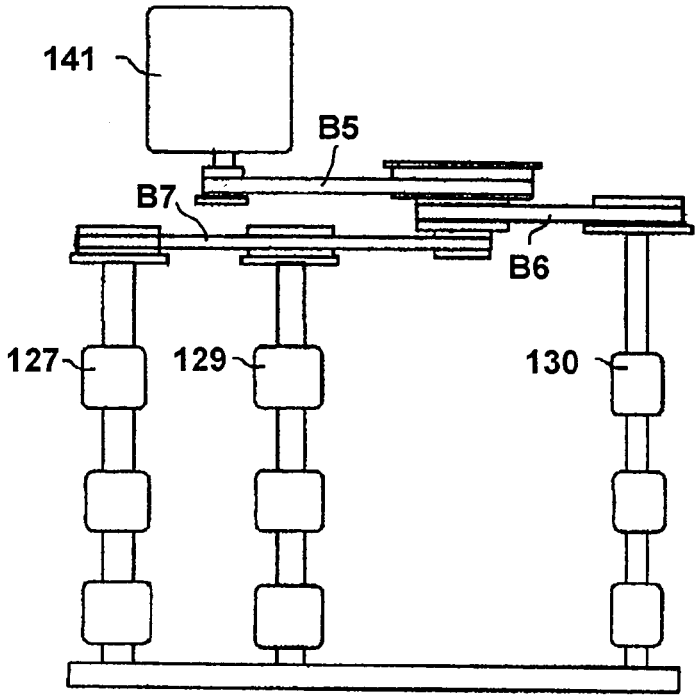

FIGS. 9A and 9B show drive mechanisms of the separation roller 119 and the register roller 125, respectively. A paper feed drive motor 140 capable of turning forward and backward drives the kick roller 118, the separation roller 119, and the register roller 125. A transport drive motor 141 drives the feed roller 127, the unloading roller 129, and the exit roller 130. The paper feed drive motor 140 turns forward to rotate the kick roller 118 and the separation roller 119. The paper feed drive motor 140 turns backward to rotate the register roller 125. At the same time, the paper feed drive motor 140 controls an ascent and descent motion of the kick roller 118. The paper feed drive motor 140 transmits rotation only in one direction to the register roller 125 with a one-way clutch 142 through belts B1 and B2. The paper feed drive motor 140 is connected to a rotary shaft of the separation roller 119 through a one-way clutch 143. The one-way clutches 142 and 143 are set so as to transmit drive relative to each other.

The bracket 119*b* is pivotally supported on the rotary shaft of the separation roller 119 via a spring clutch 144. Drive is transmitted to the kick roller 118 mounted on the bracket 119*b* through a transmission belt B3. When the paper feed drive motor 140 turns forward, the separation roller 119 and the kick roller 118 rotate and a spring of the spring clutch 144 is released. Accordingly, the bracket 119*b* becomes free, so that the kick roller 118 lowers from a raised retraction position shown in FIG. 8A and contacts the sheet on the stacker. When the paper feed drive motor 140 turns backward, the register roller 125 rotates and the spring of the spring clutch 144 is constricted. As a result, the bracket 119*b* is raised and returned to the retracted position as shown in FIG. 8A.

Referring to FIG. 9B, the transport drive motor 141 is connected to the feed roller 127, the unloading roller 129, and the exit roller 130 through belts B5, B6, and B7. The feed roller 127 and the unloading roller 129 turn in one direction through the one-way clutch when the transport drive motor 141 turns forward or backward. The exit roller 130 turns forward or backward as the transport drive motor 141 turns forward or backward.

Various sensors are disposed on the transport path 134 for detecting the leading end of the sheet. The sensors together with functions thereof will be described next. The paper feeding stacker 115 includes a plurality of the size sensors 132 for detecting a standard size of the sheet loaded thereon. The size sensors 132 detect a size of the sheet for control of transport of subsequent sheets. The empty sensor 117 on a leading end portion of the paper feeding stacker 115 detects the sheet loaded in the paper feeding stacker 115. The empty sensor 117 detects feeding of the last sheet and sends a corresponding signal to the image reading apparatus A or other processing apparatus. The double feed detection device 123 and the sheet end detection device 124 are disposed at a downstream side of the separation roller 119.

The lead sensor 126 is disposed before the feed roller 127 for detecting the leading end of the sheet reaching the lead sensor 126 and sending a signal to the image reading apparatus, thereby determining a starting line for reading an image or printing. At the same time, when the sheet is not detected for a predetermined period of time after the paper feed instruction signal is received from the register roller 125, it is determined as a paper jam, so that the drive motor stops and an alarm signal is issued. An exit sensor 145 is disposed at a downstream side of the unloading roller 129 for detecting the leading and trailing ends of the sheet to determine a paper jam.

Figure 10:
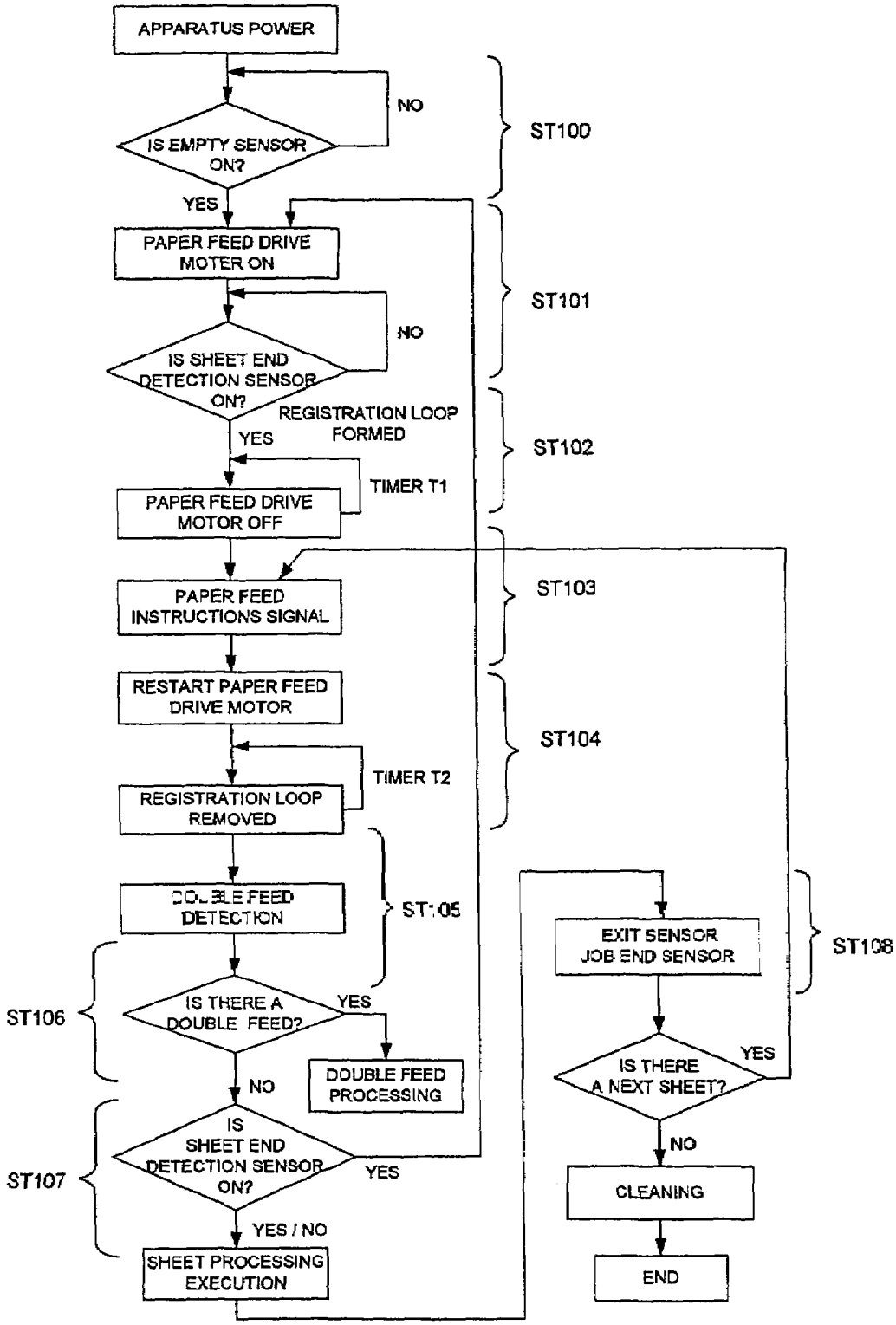
FIG. 10 is a flowchart for explaining control of the image forming apparatus shown in FIG. 7.

An operation of the aforementioned apparatus will be described next. FIG. 10 is a flowchart for explaining control of the apparatus. The apparatus is turned on and a stack of the sheets is placed on the paper feeding stacker 115. The empty sensor 117 detects the sheets when the stack is placed on the paper feeding stacker 115. The paper feed drive motor 140 is turned on (ST100).

The paper feed drive motor 140 rotates the kick roller 118 and the separation roller 119 to separate and feed the sheet from the sheet stack. The sheet is then fed onto the transport guide 128 between the separation roller 119 and the register roller 125. The sheet end detection device 124 (sensor 124) detects the leading end of the sheet (ST101). The timer T1 (see FIG. 4) starts upon the sheet leading end detection signal. After a predetermined period of time, the paper feed drive motor 140 is turned off (ST102).

Figure 11A:
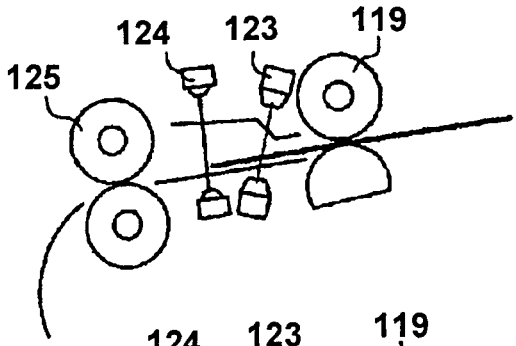
FIGS. 11A to 11E are views showing a process of feeding a sheet in the image forming apparatus shown in FIG. 7.
Figure 11B:
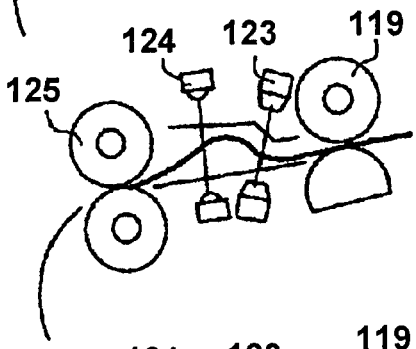
Figure 11C:
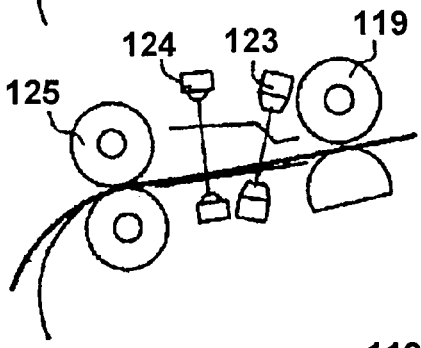

Referring to FIG. 11A, the sensor 124 detects the leading end of the sheet, and the timer T1 starts. As shown in FIG. 11B, the leading end of the sheet contacts the register roller 125 to bend the sheet. Accordingly, a loop is formed in the sheet before the register roller 125. When the timer T1 expires in this state, the paper feed drive motor 140 is turned off. When the paper feed instruction signal is transmitted from the processing unit of the image reading apparatus A, the paper feed drive motor 140 is turned on again to rotate backward (ST103). The timer T2 starts upon the paper feed instructions signal, so that the loop formed in the sheet is removed and the sheet is supported and transported in a straight position between the separation roller 119 and the register roller 125 as shown in FIG. 11C (ST104).

Figure 11D:
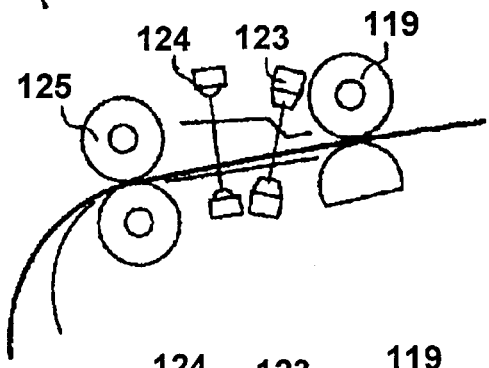
Figure 11E:
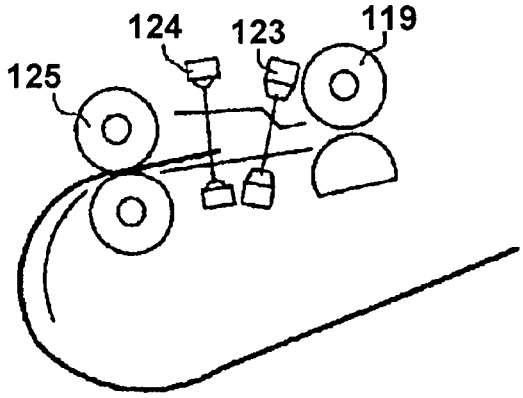

Referring to FIG. 11D, the double feed of the sheets is detected by the double feed detection device 123 until the trailing end of the sheet leaves the separation roller 119 (ST105). The sensor 124 detects the trailing end of the sheet while the sheet is transported in the aforementioned manner (ST106). While the trailing end of the sheet is detected, the lead sensor 126 detects the leading end of the sheet. The sheet is then fed toward the platen 112 by the feed roller 127 (ST107).

When the leading edge of the sheet is detected by the lead sensor 126 and the sheet reaches the platen 112, the optical mechanism 114 and the photoelectric conversion element 113 read the sheet and send processing data as an electric signal (ST108). After the reading operation, the sheet is fed to the paper exit stacker 116 by the unloading roller 129 and the exit roller 130. The exit sensor 145 detects the sheet moving out of the apparatus onto the paper exit stacker 116 (ST109).

While the sheet is transported from the paper feeding stacker 115 to the platen 112 through the processes described above, the detection signals of the double feed detection device 123 and the sheet end detection device 124 are processed between the first transport device (separation roller 119) and the second transport device (register roller pair 125*a* and 125*b*) to determine the double feed as follows.

Figure 12A:
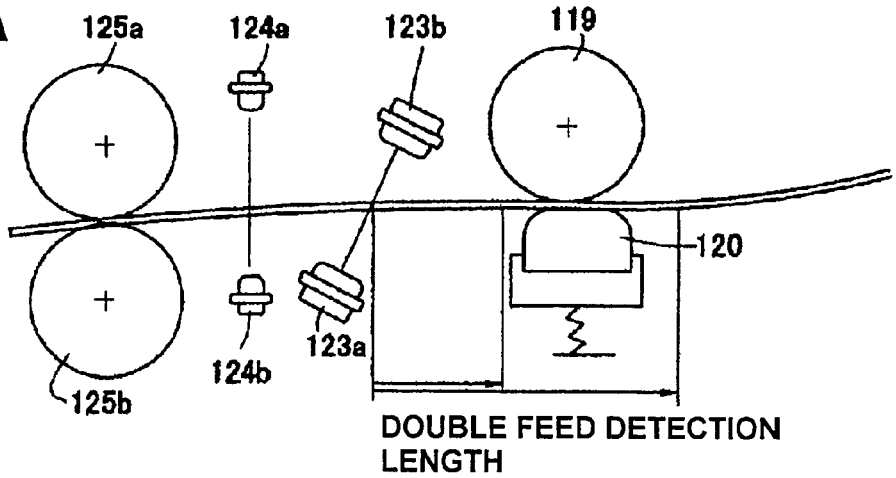
FIGS. 12A to 12C are views showing the process of feeding a sheet in the image forming apparatus shown in FIG. 7.
Figure 12B:
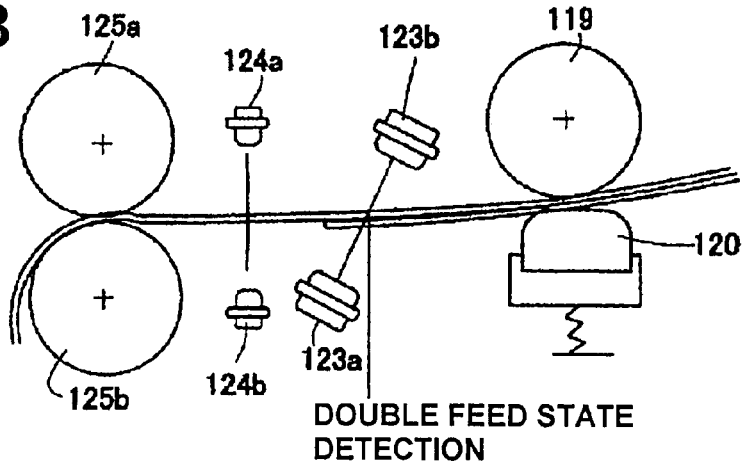
Figure 12C:
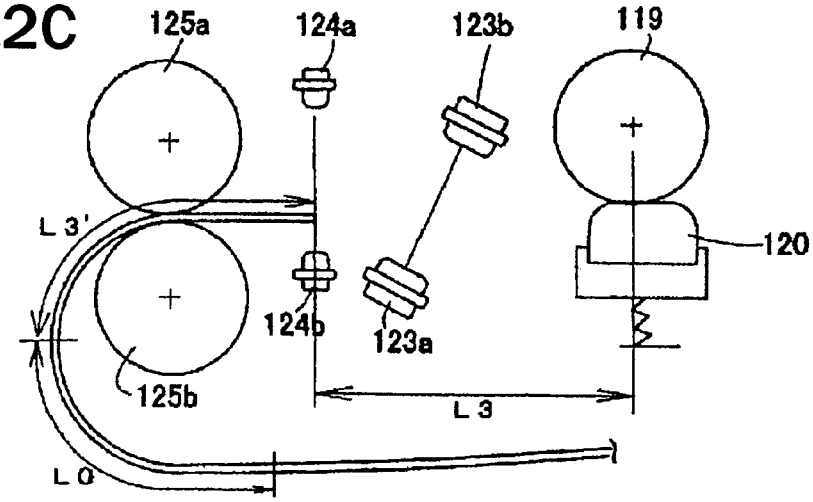

As described above, the leading end of the sheet is detected by the sheet end detection device 124, and the double feed detection sequence starts while the sheet is nipped between the first and second transport devices. FIG. 12A shows a condition in which the double feed detection sequence starts (see ST01 in FIG. 5). While the sheet is transported over a predetermined detection length L0, the output signal from the double feed detection device 123 is compared with the reference value (first comparison device). Then, in a condition shown in FIG. 12B, the double feed detection device 123 detects the double feed and transmits the double feed signal. With the double feed signal, the counter 18 (see FIG. 3) starts counting the number of drive pulses of the drive motor M of the register roller pair 125. When the trailing end of the sheet reaches the sheet end detection device as shown in FIG. 12C, the counter 18 stops counting. A reading of the counter 18 at this time is compared with the set value. If the count is smaller than the set value, the double feed signal is ignored. If the count is greater than the set value, the double feed signal is regarded as valid and the double feed processing signal is transmitted.

As described above, the set value is set with reference to the distance L3 between the first transport device (separation roller 119) located at an upstream side of the double feed detection device 123 and the sheet end detection device 124. When the double feed detection device 123 detects the double feed, if the trailing end of the sheet leaves the first transport device, the double feed signal is ignored. If the trailing end of the sheet is nipped by the first transport device, the double feed signal is handled as valid.

As explained above, in the present invention, the double feed detection device such as the ultrasonic sensor detects the sheet overlap between at least two transport devices, the first and second transport devices, with a predetermined distance in between. The detection signal is treated as valid to determine the sheet overlap or invalid based on the amount of movement of the sheet to the trailing end of the sheet. The sheet overlap is detected with the sheet in an appropriate detection position, i.e. the trailing end of the sheet is supported by the transport device when the detection signal is transmitted, thereby accurately detecting the double feed.

Further, in the present invention, when the ultrasonic sensor detects the double feed, the measurement range is set long in the sheet transport direction. Accordingly, in a steady state wave or a plurality of burst waves, it is possible to invalidate the detection signal when the trailing end of the sheet leaves the transport device, thereby detecting the sheet overlap over an extended range.

In the present invention, even when the image reading apparatus handles a wide variety of sheets in terms of quality, weight, or size, it is possible to accurately detect the double feed with the simple structure.

The disclosure of Japanese Patent Application No. 2003-405441, filed on Dec. 4, 2003, is incorporated in the application.

While the invention has been explained with reference to the specific embodiments of the invention, the explanation is illustrative and the invention is limited only by the appended claims.

What is claimed is:

1. A sheet feeding apparatus, comprising:

a stacker for storing a sheet, a transport guide for guiding the sheet from the stacker to a processing position, a first transport device disposed at the transport guide for nipping and transporting the sheet, a second transport device disposed at the transport guide at a position away from the first transport device for nipping and transporting the sheet, a double feed detection device disposed between the first transport device and the second transport device for detecting a double feed of sheets, a sheet end detection device disposed at a downstream side of the double feed detection device and between the first transport device and the second transport device for detecting a trailing end of the sheet, and a determination device electrically connected to the double feed detection device and the sheet end detection device for determining the double feed based on a detection signal from the double feed detection device and a detection signal from the sheet end detection device indicating a transport length of the sheet during a period from when the double feed detection device detects the sheet to when the trailing end of the sheet reaches the sheet end detection device.

2. A sheet feeding apparatus according to claim 1, wherein said determination device determines the double feed when the transport length of the sheet during the period from when the double feed detection device detects the double feed to when the sheet end detection device detects the trailing end of the sheet is greater than a predetermined length.

3. A sheet feeding apparatus according to claim 1, wherein said determination device includes a measurement device for determining the transport length of the sheet, said measurement device starting to measure the transport length of the sheet when the double feed detection device detects the double feed so that the determination device determines the double feed in case the transport length of the sheet exceeds a predetermined length and the sheet end detection device does not detect the trailing end of the sheet.

4. A sheet feeding apparatus according to claim 1, wherein said determination device includes a timekeeping device for measuring a period of time during an operation of at least one of the first transport device and the second transport device.

5. A sheet feeding apparatus according to claim 1, wherein said determination device includes a distance measurement device for measuring the transport length of the sheet transported by at least one of the first transport device and the second transport device.

6. A sheet feeding apparatus according to claim 1, wherein said sheet end detection device includes a sheet sensor for detecting the sheet so that the first transport device and the second transport device are controlled to activate the double feed detection device after the second transport device nips a leading end of the sheet based on a signal from the sheet sensor detecting the leading end of the sheet.

7. A sheet feeding apparatus according to claim 1, wherein said first transport device includes a separation roller for separating and transporting the sheet from the stacker, said second transport device includes a register roller for setting the sheet temporarily in a standby state, and said sheet end detection device includes an optical sensor disposed between the separation roller and the register roller.

8. A sheet feeding apparatus according to claim 1, wherein said double feed detection device includes a wave transmission element for transmitting an ultrasonic wave with a predetermined frequency and a wave reception element for receiving the ultrasonic wave from the wave transmission element, said wave transmission element being disposed below the sheet in a direction of gravity and said wave reception element being disposed above the sheet in the direction of gravity.

9. A sheet feeding apparatus according to claim 1, wherein said double feed detection device includes a wave transmission element for transmitting an ultrasonic wave with a specific frequency over a measurement range with a predetermined length extending in a direction that the sheet is transported and a wave reception element for receiving the ultrasonic wave from the wave transmission element, and said determination device includes a first comparator circuit for comparing an output signal from the wave transmission element with a predetermined reference value and a second comparator circuit for comparing a transport length of the sheet during a period from when the wave transmission element sends the output signal to when the sheet end detection device detects the trailing end of the sheet with a predetermined length.

10. A sheet feeding apparatus according to claim 1, wherein the first transport device and the sheet end detection device are arranged such that when the double feed is detected in a condition that the sheet is held by the first transport device, the determination device accepts a double feed signal.

11. A sheet feeding apparatus according to claim 10, wherein said sheet end detection device detects the condition that the sheet is held by the first transport device.

12. An image reading apparatus, comprising:

a stacker for storing a sheet, a transport guide for guiding the sheet from the stacker to a reading platen, a separation roller for separating and feeding the sheet from the stacker, a register roller for temporarily setting the sheet from the separation roller in a standby state, a double feed detection device disposed between the separation roller and the register roller for detecting a double feed of the sheet, a sheet end detection device disposed between the double feed detection device and the register roller at a downstream side of the double feed detection device for detecting a leading end and a trailing end of the sheet, and a determination device electrically connected to the double feed detection device and the sheet end detection device for determining the double feed based on a detection signal from the double feed detection device and a detection signal from the sheet end detection device, said determination device including a first comparison device for comparing the detection signal from the double feed detection device with a predetermined reference value in a condition that the register roller nips the leading end of the sheet based on the detection signal from the sheet end detection device, and a second comparison device for comparing a transport length of the sheet for a period from when the double feed detection device sends the detection signal to when the sheet end detection device detects the trailing end of the sheet with a predetermined length.

13. An image reading apparatus according to claim 12, wherein said determination device determines the double feed of the sheet by validating comparison data of the first comparison device according to a result of the second comparison device.

14. A method of detecting a double feed of a sheet, comprising:

detecting a double feed of a sheet during a process of transporting the sheet from a first transport device to a second transport device, measuring a transport length of the sheet in transporting the sheet between the first and second transport devices for a period from when the double feed is detected in the detecting step to when a trailing end of the sheet reaches the predetermined position, and determining the double feed based on signals from the double feed and the transport length, the double feed being determined by validating detection data obtained in the detecting step when the transport length of the sheet measured in the measuring step is greater than a predetermined length, wherein in the measuring step, the transport length of the sheet is measured based on a detection signal from a sheet end detection device disposed between the first and second transport devices for detecting the trailing end of the sheet, and in the determining step, the double feed is determined by validating the detection data obtained in the detecting step when the transport length of the sheet is greater than a length between the first transport device and the sheet end detection device.

* * * * *